US010216106B2

(12) United States Patent
Miyakai et al.

(10) Patent No.: US 10,216,106 B2
(45) Date of Patent: Feb. 26, 2019

(54) METHOD FOR PRODUCING TONER

(71) Applicant: CANON KABUSHIKI KAISHA, Tokyo (JP)

(72) Inventors: Tomoyo Miyakai, Kashiwa (JP); Junichi Tamura, Toride (JP); Hayato Ida, Toride (JP); Takaho Shibata, Tokyo (JP); Kouichirou Ochi, Chiba (JP); Yuya Chimoto, Funabashi (JP); Ryuji Murayama, Nagareyama (JP); Daisuke Yamashita, Tokyo (JP); Akemi Watanabe, Hiratsuka (JP); Takashi Hirasa, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/576,240

(22) PCT Filed: May 23, 2016

(86) PCT No.: PCT/JP2016/002496

§ 371 (c)(1),
(2) Date: Nov. 21, 2017

(87) PCT Pub. No.: WO2016/189851

PCT Pub. Date: Dec. 1, 2016

(65) Prior Publication Data

US 2018/0143547 A1 May 24, 2018

(30) Foreign Application Priority Data

May 27, 2015 (JP) ..... 2015-107872
Apr. 26, 2016 (JP) ..... 2016-088542

(51) Int. Cl.
*G03G 9/087* (2006.01)
*G03G 9/08* (2006.01)

(52) U.S. Cl.
CPC ..... *G03G 9/0804* (2013.01); *G03G 9/08704* (2013.01); *G03G 9/08722* (2013.01); *G03G 9/08755* (2013.01); *G03G 9/08797* (2013.01)

(58) Field of Classification Search
CPC ..... G03G 9/08704; G03G 9/08728; G03G 9/08724; G03G 9/0804; G03G 9/08755; G03G 9/08797
See application file for complete search history.

(56) References Cited

U.S. PATENT DOCUMENTS

2003/0219665 A1* 11/2003 Matsumura ..... G03G 9/0819 430/108.1
2004/0209181 A1 10/2004 Higuchi

FOREIGN PATENT DOCUMENTS

| | | | |
|---|---|---|---|
| JP | 56-13943 | B2 | 4/1981 |
| JP | 59-18954 | A | 1/1984 |
| JP | 62-39428 | B2 | 8/1987 |
| JP | 4-21860 | A | 1/1992 |
| JP | 4-120554 | A | 4/1992 |
| JP | 6-308764 | A | 11/1994 |
| JP | 8-184986 | A | 7/1996 |
| JP | 11-202555 | A | 7/1999 |
| JP | 11-311877 | A | 11/1999 |
| JP | 2001-209212 | A | 8/2001 |
| JP | 2011-107261 | A | 6/2011 |
| JP | 2011-237790 | A | 11/2011 |
| JP | 2015-175938 | A | 10/2015 |

OTHER PUBLICATIONS

Applicants' English-language translation of Japanese Patent Publication No. 56-13943 (pub. Apr. 1981).*

* cited by examiner

*Primary Examiner* — Janis L Dote

(74) *Attorney, Agent, or Firm* — Canon U.S.A.Inc., IP Division

(57) ABSTRACT

A method for producing a toner includes a step (1) of forming resin microparticles in an aqueous medium in the presence of a surfactant, a step (2) of aggregating the resin microparticles to form aggregated particles, and a step (3) of heating and the aggregated particles and allowing the aggregated particles to coalesce to form toner particles, in which a resin component in the resin microparticles contains an olefinic copolymer and resin A, the resin A has an acid value of 1 mgKOH/g or more and 50 mgKOH/g or less, the resin A has a SP value of 19.0 $(J/cm^3)^{0.5}$ or more and 21.0 $(J/cm^3)^{0.5}$ or less, and the resin component has an olefinic copolymer content of 50% by mass or more with respect to the total mass of the resin component.

10 Claims, No Drawings

METHOD FOR PRODUCING TONER

CROSS-REFERENCE TO RELATED APPLICATIONS

This application is a National Stage filing of International Application No. PCT/JP2016/002496 filed May 23, 2016, which claims the benefit of Japanese Patent Application No. 2015-107872, filed May 27, 2015, and Japanese Patent Application No. 2016-088542, filed Apr. 26, 2016 the disclosures of each of which are hereby incorporated by reference herein in their entirety.

TECHNICAL FIELD

The present invention relates to a dry toner used for electrophotographic systems.

BACKGROUND ART

In recent years, with an increase in demand for energy savings in image formation with electrophotographic apparatuses, reductions in fixing temperatures of toners have been tackled. As examples of a method for improving low-temperature fixability, techniques for using crystalline polyester resins having sharp melting properties in which their viscosities decrease at temperatures higher than their melting points have been reported (PTLs 1 to 3).

As other examples of a method for improving low-temperature fixability, reductions in fixing temperatures by the use of resins having low glass transition temperatures have been reported. Toners each containing an ethylene-vinyl acetate copolymer serving as a resin having a low glass transition temperature have been reported (PTLs 4 to 8).

As a method for producing a toner, an emulsion aggregation method has been receiving attention from the viewpoint of easily controlling the particle size distribution, the particle size, and the form of a toner. The emulsion aggregation method is a method for producing toner particles, the method including an emulsification step of preparing a dispersion of resin microparticles in an aqueous medium, an aggregation step of aggregating the resin microparticles to form aggregated particles, a coalescence step of heating the aggregated particles and allowing the aggregated particles to coalesce, and filtration and washing steps (PTLs 9 and 10).

CITATION LIST

Patent Literature

PTL 1: Japanese Patent Publication No. 56-13943
PTL 2: Japanese Patent Publication No. 62-39428
PTL 3: Japanese Patent Laid-Open No. 4-120554
PTL 4: Japanese Patent Laid-Open No. 2011-107261
PTL 5: Japanese Patent Laid-Open No. 11-202555
PTL 6: Japanese Patent Laid-Open No. 8-184986
PTL 7: Japanese Patent Laid-Open No. 4-21860
PTL 8: Japanese Patent Laid-Open No. 59-18954
PTL 9: Japanese Patent Laid-Open No. 2015-175938
PTL 10: Japanese Patent Laid-Open No. 11-311877
PTL 11: Japanese Patent Laid-Open No. 2001-209212

SUMMARY OF INVENTION

Technical Problem

In the case where a crystalline polyester resin of the related art is used as a resin for an electrophotographic toner, the resulting toner has good low-temperature fixability because of the sharp melting properties of the resin. However, the crystalline polyester resin has low electrical resistance and thus has a problem with the charge retention characteristics of the toner.

PTLs 4 to 7 each disclose a toner partially containing an ethylene-vinyl acetate copolymer that is a resin having a low glass transition temperature and low electrical resistance. It is difficult to achieve good low-temperature fixability under high-speed conditions just by allowing the toner to partially contain the ethylene-vinyl acetate copolymer.

As disclosed in PTL 8, in the case where a low-molecular-weight ethylene-vinyl acetate copolymer is used as a main component of a binder resin, the low-molecular-weight ethylene-vinyl acetate copolymer has low strength and thus has a problem with storage stability.

In the case where a high-molecular-weight ethylene-vinyl acetate copolymer is used as a main component of a binder resin, the production of a toner is problematic. In a pulverization method, which is a common method for producing a toner, the high-molecular-weight ethylene-vinyl acetate copolymer is not easily pulverized because of its high viscosity and elasticity. In an emulsion aggregation method, a dispersion of resin particles needs to be prepared in an emulsification step. However, the high-molecular-weight ethylene-vinyl acetate copolymer has high viscosity and high hydrophobicity. It is thus difficult to reduce the particle size to a predetermined particle size. Furthermore, even if microparticulation is performed with a large amount of s surfactant, the state of the microparticles cannot be stably maintained. After the preparation of a dispersion of the resin microparticles, the particle size is increased. When an aggregation step in the emulsion aggregation method is performed with the foregoing resin microparticles, the aggregation and the termination of the aggregation of the resin microparticles cannot be controlled, so that aggregated particles having predetermined particle size are not produced. In addition, poor pigment dispersion in the resin microparticles of the resulting toner disadvantageously reduces the image density of a fixed article.

The present invention provides a method for producing a toner containing an ethylene-vinyl acetate copolymer as a main component of a binder resin, the toner having good low-temperature fixability, good storage stability, good charge retention characteristics, a sharp particle size distribution, and a good pigment dispersion in resin microparticles.

Solution to Problem

The inventors have conducted intensive studies and have found that in a step (1) of forming resin microparticles mainly composed of an ethylene-vinyl acetate copolymer having sufficiently high molecular weight by an emulsion aggregation method in the presence of a surfactant, resin A having an acid value and a SP value of 19.0 $(J/cm^3)^{0.5}$ or more and 21.0 $(J/cm^3)^{0.5}$ or less is also used to form the resin microparticles containing both the ethylene-vinyl acetate copolymer and the resin A in an aqueous medium, so that the foregoing problems are solved.

The present invention relates to a method for producing a toner, the method including:

a step (1) of forming resin microparticles in an aqueous medium in the presence of a surfactant;

a step (2) of aggregating the resin microparticles to form aggregated particles; and a step (3) of heating and the aggregated particles and allowing the aggregated particles to coalesce to form toner particles, in which a resin component in the resin microparticles contains an olefinic copolymer and resin A, in which the olefinic copolymer contains unit Y1 represented by formula (1), and unit Y2 that is at least one selected from the group consisting of a unit represented by formula (2) and a unit represented by formula (3), the olefinic copolymer has a melt flow rate equal to or more than 5 g/10 minutes and equal to or less than 30 g/10 minutes, the resin A has an acid value of 1 mgKOH/g or more and 50 mgKOH/g or less, the olefinic copolymer has a SP value of 16.0 $(J/cm^3)^{0.5}$ or more and 19.0 $(J/cm^3)^{0.5}$ or less, the resin A has a SP value of 19.0 $(J/cm^3)^{0.5}$ or more and 21.0 $(J/cm^3)^{0.5}$ or less, the resin component has an olefinic copolymer content of 50% by mass or more with respect to the total mass of the resin component, the resin component has a resin A content of 10% by mass or more and 50% by mass or less with respect to the total mass of the resin component, and the olefinic copolymer has a unit Y2 content of 3% by mass or more and 35% by mass or less with respect to the total mass of the olefinic copolymer,

[Chem. 1]

(1)

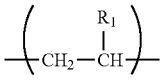

(2)

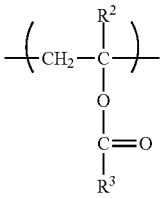

(3)

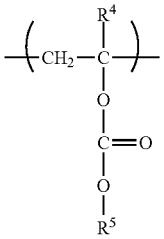

(where $R^1$ denotes H or $CH_3$, $R^2$ denotes H or $CH_3$, $R^3$ denotes $CH_3$ or $C_2H_5$, $R^4$ denotes H or $CH_3$, and $R^5$ denotes $CH_3$ or $C_2H_5$).

The combination use of the resin A improves the stability in the formation of the resin microparticles in the presence of the surfactant. Even though the resin microparticles are stored, the microparticle state is maintained. The reason for this is not clear but is presumably as follows: In the case where the resin A is not present in the resin microparticles, ethylene moieties of the ethylene-vinyl acetate copolymer are gradually crystallized in the resin microparticles. At this time, the copolymer is seemingly aggregated together with other microparticles to increase the particle size. The resin A has the SP value described above and seemingly has a high affinity for the ethylene moieties of the ethylene-vinyl acetate copolymer. Thus, in the case where the resin A is contained in the resin microparticles, the resin A is present between ethylene chains of the ethylene-vinyl acetate copolymer, and moieties of the resin A having acidic polar groups seemingly inhibit crystal growth to enable the microparticle state to be maintained.

The combination use of the resin A enables the control of the particle size in the step (2) in the method for producing a toner according to the present invention. Specifically, aggregation is terminated at the time when the aggregation proceeds to a predetermined particle size, thereby enabling the formation of aggregated particles having a predetermined particle size. In the case where the resin A is not present in the resin microparticles, the resin microparticles have no reactive site for an aggregation reaction because the ethylene-vinyl acetate copolymer does not have an acid value. It is thus necessary to use a surfactant serving as reactive sites in order to aggregate the ethylene-vinyl acetate copolymer microparticles. However, the adsorption of the surfactant on the resin microparticles is seemingly in equilibrium with desorption. The surfactant adsorbed during aggregation can be desorbed at the time of the termination of the aggregation. Thus, in the case where the surfactant is used as the reactive sites, it is very difficult to control the particle size in the step (2). In the case where the resin A is present in the resin microparticles, the acidic polar groups of the resin A seemingly function as reactive sites for the aggregation reaction. Furthermore, the resin A has a higher affinity for the ethylene-vinyl acetate copolymer than that of the surfactant and thus is presumed not to be detached at the time of the termination of the aggregation. This seemingly enables the control in the step (2) in the method for producing a toner according to the present invention.

In the method for producing a toner according to the present invention, a good pigment dispersion is provided. The reason for this is not clear but is presumably that the acidic polar groups of the resin A interact with the pigment to stabilize the dispersion.

Advantageous Effects of Invention

A method for producing a toner according to the present invention enables the production of a toner which contains a resin mainly composed of the ethylene-vinyl acetate copolymer and which achieves good low-temperature fixability, good charge retention characteristics, and good image quality.

DESCRIPTION OF EMBODIMENTS

Materials used in a method for producing a toner according to the present invention will be described below.

A resin component used in the present invention indicates a polymer component that mainly contributes to fixing performance. Examples of the resin component include olefinic copolymers and aliphatic polyester resins (hereinafter, also referred to as "crystalline polyesters").

An olefinic copolymer that contains unit Y1 represented by formula (1) in the present invention and unit Y2 that is at least one selected from the group consisting of a unit represented by formula (2) and a unit represented by formula (3) will be described.

Examples of the olefinic copolymer according to the present invention is an ethylene-vinyl acetate copolymer containing a unit represented by formula (1) where $R^1$ denotes H, and a unit represented by formula (2) where $R^2$ denotes H, and $R^3$ denotes $CH_3$; an ethylene-methyl acrylate copolymer containing a unit represented by formula (1) where $R^1$ denotes H, and a unit represented by formula (3) where $R^4$ denotes H, and $R^5$ denotes $CH_3$; an ethylene-ethyl acrylate copolymer containing a unit represented by formula (1) where $R^1$ denotes H, and a unit represented by formula (3) where $R^4$ denotes H, and $R^5$ denotes $C_2H_5$; and an ethylene-methyl methacrylate copolymer containing a unit represented by formula (1) where $R^1$ denotes H, and a unit represented by formula (3) where $R^4$ denotes $CH_3$, and $R^5$ denotes $CH_3$.

The ethylene-vinyl acetate copolymer can be used as the olefinic copolymer from the viewpoint of easily achieving both good low-temperature fixability and good charge retention characteristics because of its low melting point even at a low ester group concentration. An acrylate copolymer, for example, the ethylene-ethyl acrylate copolymer, the ethylene-methyl acrylate copolymer, or the ethylene-methyl methacrylate copolymer, can be used in view of its high chemical stability and good storage stability in a high-temperature and high-humidity environment.

One or more types of the olefinic copolymers may be contained in the resin component.

The olefinic copolymer used in the present invention needs to be preferably contained in the resin component in an amount of 50% by mass or more and more preferably 70% by mass or more with respect to the total mass of the resin component from the viewpoint of achieving good low-temperature fixability under high-speed conditions. The olefinic copolymer has a glass transition temperature of 0° C. or lower. Thus, when the olefinic copolymer is contained in an amount of 50% by mass or more with respect to the total mass of the resin component, good low-temperature fixability under high-speed conditions is provided.

In the olefinic copolymer, the proportion of a unit derived from the unit Y2 needs to be 3% by mass or more and 35% by mass or less, and preferably 5% by mass or more and 20% by mass or less with respect to the total mass of the olefinic copolymer. When the proportion of the unit derived from the unit Y2 is 20% by mass or less, the resulting toner has good charging characteristics. When the proportion of the unit derived from the unit Y2 is 5% by mass or more, good adhesion to paper is provided, thus leading to good low-temperature fixability.

The proportion of the unit may be measured by a common analytical method. For example, nuclear magnetic resonance (NMR) spectroscopy or pyrolysis gas chromatography may be employed.

In measurement by $^1$H-NMR spectroscopy, integrated values corresponding to hydrogen atoms of $CH_2$—$CH_2$ in an ethylene unit and hydrogen atoms of $CH_3$ in a vinyl acetate unit are determined and compared to each other, so that the proportions of the units are calculated.

For example, the proportion of the unit in the olefinic copolymer (the proportion of the unit derived from vinyl acetate: 15% by mass) is calculated by the following method: A sample solution is prepared by dissolving about 5 mg of a sample in 0.5 mL of deuterated acetone containing tetramethylsilane ($\Delta$=0.00 ppm) serving as an internal standard. The solution is charged into a sample tube. The sample solution is analyzed by $^1$H-NMR spectroscopy under condition as follows: repetition time: 2.7 seconds, and the number of acquisitions: 16. A peak at 1.14 to 1.36 ppm corresponds to $CH_2$—$CH_2$ in the ethylene unit. A peak at about 2.04 ppm corresponds to $CH_3$ in the vinyl acetate unit. The ratio of the integrated values of these peaks is calculated.

In the present invention, the olefinic copolymer may be modified to the extent that its characteristics are not substantially impaired. Examples of a method for modifying the olefinic copolymer include a method in which in polymerization, another monomer in addition to ethylene and vinyl acetate is partially mixed, and the resulting mixture is polymerized; and a method in which the olefinic copolymer is partially saponified.

The olefinic copolymer needs to have a melt flow rate equal to or more than 5 g/10 minutes and equal to or less than 30 g/10 minutes. At a melt flow rate more than the range, the resulting toner has low strength, and blocking occurs during storage. At a melt flow rate less than the range, it is difficult to form resin microparticles in an emulsification step. From the viewpoint of withstanding impact and pressure at the time of use of the toner, a melt flow rate equal to or less than 20 g/10 minutes is preferred.

The melt flow rate is measured at 190° C. and a load of 2160 g according to JIS K 7210. The melt flow rate may be controlled by changing the molecular weight of the olefinic copolymer. A higher molecular weight results in a lower melt flow rate. Specifically, the olefinic copolymer preferably has a weight-average molecular weight of 50,000 or more and more preferably 100,000 or more. The olefinic copolymer preferably has a molecular weight of 500,000 or less in view of the gloss of an image.

The olefinic copolymer preferably has an elongation at break of 300% or more and more preferably 500% or more. An elongation at break of 300% or more results in a fixed article with good bending resistance. The elongation at break is measured under conditions according to JIS K 7162.

The olefinic copolymer used in the present invention has a SP value of 16.0 $(J/cm^3)^{0.5}$ or more and 19.0 $(J/cm^3)^{0.5}$ or less. A SP value less than 16.0 $(J/cm^3)^{0.5}$ results in a lower unit Y2 content to reduce compatibility with the resin A, causing difficulty in controlling the particle size. A SP value more than 19.0 $(J/cm^3)^{0.5}$ is liable to lead to a reduction in unit Y1 content. In this case, the resulting toner is liable to have lower chargeability. The olefinic copolymer preferably has a SP value of 18 $(J/cm^3)^{0.5}$ or more and 19.0 $(J/cm^3)^{0.5}$ or less.

The resin A used in the present invention has an acid value. The resin A needs to be contained in an amount of 10% by mass or more and 50% by mass or less with respect to the total mass of the resin component. The resin A is preferably contained as a resin component in an amount of 10% by mass or more and 30% by mass or less. When the resin A content is within the range described above, the stability of the resin microparticles in the step (1) and the controllability of the particle size distribution in the step (2) described below are sufficiently provided without reducing chargeability. The resin A needs to be a resin having a SP value of 19 $(J/cm^3)^{0.5}$ or more and 21 $(J/cm^3)^{0.5}$ or less. The SP value indicates a solubility parameter. Two resins having closer SP values are more easily compatible with each other. When the resin A has a SP value within the range described above, the resin A has a high affinity for olefinic moieties in the olefinic copolymer; hence, when the resin microparticles are stored, the stable state of the resin microparticles is seemingly maintained without increasing the particle size. The resin A is more hydrophilic than the olefinic copolymer. It is thus speculated that the acidic polar groups of the resin A are more likely to be present on surfaces of the resin microparticles. The acidic polar groups of the resin A sufficiently act as reactive sites for an aggregation reaction. This will result in good particle size controllability.

The SP value may be determined from the Fedors equation. The values of Δei and Δvi were obtained by referring to "Evaporation energies and molar volumes (25° C.) of atoms and atomic groups" in Tables 3 to 9 of "Coating no Kiso Kagaku (Basic Science for Coating)", pp. 54-57, 1986 (Maki Shoten).

$$\delta i=[Ev/V]^{(1/2)}=[\Delta ei/\Delta vi]^{(1/2)} \quad \text{Equation:}$$

Ev: evaporation energy

V: molar volume

Δei: evaporation energy of atoms or atomic groups of component i

Δvi: molar volume of atoms or atomic groups of component i

The resin A preferably has a SP value of 19.0 $(J/cm^3)^{0.5}$ or more and 20.0 $(J/cm^3)^{0.5}$ or less in view of compatibility with the olefinic copolymer.

In the present invention, the resin A can have a melting point of 50° C. or higher and 100° C. or lower in view of the low-temperature fixability and the storage stability. A melting point of 100° C. or lower further improves the low-temperature fixability. A melting point of 90° C. or lower still further improves the low-temperature fixability. A melting point lower than 50° C. is liable to reduce the storage stability.

The melting point of the resin A may be measured with a differential scanning calorimeter (DSC).

Specifically, 0.01 g or more and 0.02 g or less of a sample is accurately weighed in an aluminum pan. The sample is heated from 0° C. to 200° C. at a heating rate of 10° C./min to obtain a DSC curve.

The peak temperature of an endothermic peak in the resulting DSC curve is defined as a melting point.

The resin A preferably has a weight-average molecular weight of 1000 or more and 500,000 or less and more preferably 10,000 or more and 500,000 or less. A weight-average molecular weight of 1000 or more results in high adhesion to the olefinic copolymer. Thus, the resin A is presumed not to be desorbed at the time of the termination of aggregation, thereby leading to good controllability of the particle size distribution. A weight-average molecular weight of 500,000 or less results in good low-temperature fixability of the toner.

The structure of the resin A is not limited. Examples of the resin A include polyester resins, polyurethane resins, polyvinyl chloride resins, and crystalline polyester resins. Of these, a crystalline polyester resin can be used in view of the gloss of an image. In particular, an aliphatic polyester resin can be used.

In the present invention, any crystalline polyester resin may be used as long as it has an acid value and a SP value of 19 $(J/cm^3)^{0.5}$ or more and 21 $(J/cm^3)^{0.5}$ or less. An example of the structure is a structure formed by the polycondensation of at least one dicarboxylic acid component and at least one diol component.

Specific examples of the diol component are described below. An aliphatic diol having 4 to 20 carbon atoms can be used in view of the concentration of ester groups and the melting point. Examples of the aliphatic diol include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, 1,20-eicosanediol, 2-methyl-1,3-propanediol, cyclohexanediol, and cyclohexanedimethanol. These may be used separately or in combination of two or more.

Specific examples of the dicarboxylic acid are described below. An aliphatic dicarboxylic acid having 4 to 20 carbon atoms can be used in view of the melting point. Examples of the aliphatic carboxylic acid include oxalic acid, malonic acid, maleic acid, fumaric acid, citraconic acid, itaconic acid, glutaconic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, and 1,18-octadecanedicarboxylic acid. These compounds may be used separately or in combination of two or more.

The resin A used in the present invention preferably has an acid value of 1 mgKOH/g or more and 50 mgKOH/g or less and more preferably 10 mgKOH/g or more and 20 mgKOH/g or less.

The acid value indicates the number of milligrams of potassium hydroxide required to neutralize an acid component, for example, nonesterified fatty acid or resin acid, contained in 1 g of a sample. A method for measurement complies with JIS K 0070 and is described below.

(1) Reagent

Solvent: A tetrahydrofuran-ethyl alcohol (2:1) mixture is neutralized with a 0.1 mol/L ethyl alcohol solution of potassium hydroxide using phenolphthalein serving as an indicator immediately before use.

Phenolphthalein solution: One gram of phenolphthalein is dissolved in 100 mL of ethyl alcohol (95% by volume).

Ethyl alcohol solution of potassium hydroxide (0.1 mol/L): In a minimum amount of water, 7.0 g of potassium hydroxide is dissolved. Ethyl alcohol (95% by volume) is added thereto to make a total volume of 1 L. The resulting solution is allowed to stand for 2 or 3 days and then filtered. Standardization is performed according to JIS K 8006 (fundamentals relating to titration among quantitative tests of reagents).

(2) Operation

First, 1 g or more and 20 g or less of a resin is accurately weighed as a sample. Then 100 mL of the solvent and a few drops of the phenolphthalein solution serving as an indicator are added thereto. The mixture is sufficiently shaken until complete dissolution of the sample. When the sample is solid, the sample is dissolved by heating in a water bath. After being cooled, the resulting solution is titrated with the 0.1 mol/L ethyl alcohol solution of potassium hydroxide. The neutralization end point is reached at the time when a pale pink color of the indicator remains for 30 seconds.

(3) Computational Expression

The acid value is calculated from the following expression:

$$A=B\times f\times 5.611/S$$

A: acid value (mgKOH/g)

B: amount of 0.1 mol/L ethyl alcohol solution of potassium hydroxide consumed (mL)

f: factor of 0.1 mol/L ethyl alcohol solution of potassium hydroxide

S: sample (g)

The toner produced by the method for producing a toner according to the present invention can contain an aliphatic hydrocarbon having a melting point of 50° C. or higher and 100° C. or lower in an amount of 1 part by mass or more and 40 parts by mass with respect to 100 parts by mass of the resin component.

In the case where the aliphatic hydrocarbon is contained, the olefinic copolymer can be plasticized by heating. Thus, in the case where the aliphatic hydrocarbon is contained in the toner, the olefinic copolymer serving as a matrix is plasticized during the fixation of the toner by heating, thereby improving the low-temperature fixability. The aliphatic hydrocarbon having a melting point of 50° C. or higher and 100° C. or lower also acts as a nucleating agent for the olefinic copolymer. Thus, the microscopic motion of the olefinic copolymer is inhibited to improve the chargeability. The aliphatic hydrocarbon can be contained in an amount of 10 parts by mass or more and 30 parts by mass or less in view of the low-temperature fixability and the chargeability.

Specific examples of the aliphatic hydrocarbon include saturated hydrocarbons, such as hexacosane, triacontane, and hexatriacontane, each having 20 to 60 carbon atoms.

The toner produced by the method for producing a toner according to the present invention can contain a silicone oil serving as a release agent. Release agents commonly used for alkyl wax-containing toners are liable to be compatible with olefinic copolymers, so that a release effect is less likely to be provided. The addition of the silicone oil improves pigment dispersion in the toner and is more likely to form a high-density image.

Examples of the silicone oil that may be used include dimethyl silicone oil, methylphenyl silicone oil, methylhydrogen silicone oil, amino-modified silicone oil, carboxy-modified silicone oil, alkyl-modified silicone oil, and fluorine-modified silicone oil. The silicone oil preferably has a viscosity of 5 cP or more and 1000 cP or less and more preferably 20 cP or more and 1000 cP or less.

The amount of the silicone oil added is preferably 1 part by mass or more and 20 parts by mass or less and more preferably 5 parts by mass or more and 20 parts by mass or less with respect to 100 parts by mass of the resin component from the viewpoint of inhibiting a reduction in flowability and achieving good releasability.

The toner produced by the method for producing a toner according to the present invention may contain a colorant as described below.

Examples of black colorants include carbon black; and colorants obtained by adjusting the color to black using yellow colorants, magenta colorants, and cyan colorants. A pigment may be used alone as a colorant. A dye and a pigment can be used in combination to improve the degree of definition from the viewpoint of achieving good image quality of a full-color image.

Examples of a pigment for use in a magenta toner include C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:2, 48:3, 48:4, 49, 50, 51, 52, 53, 54, 55, 57:1, 58, 60, 63, 64, 68, 81:1, 83, 87, 88, 89, 90, 112, 114, 122, 123, 146, 147, 150, 163, 184, 202, 206, 207, 209, 238, 269, and 282; C.I. Pigment Violet 19; and C.I. Vat Red 1, 2, 10, 13, 15, 23, 29, and 35.

Examples of a dye for use in a magenta toner include C.I. Solvent Red 1, 3, 8, 23, 24, 25, 27, 30, 49, 81, 82, 83, 84, 100, 109, and 121; C.I. Disperse Red 9; C.I. Solvent Violet 8, 13, 14, 21, and 27; oil-soluble dyes, such as C.I. Disperse Violet 1; and basic dyes, such as C.I. Basic Red 1, 2, 9, 12, 13, 14, 15, 17, 18, 22, 23, 24, 27, 29, 32, 34, 35, 36, 37, 38, 39, and 40, and C.I. Basic Violet 1, 3, 7, 10, 14, 15, 21, 25, 26, 27, and 28.

Examples of a pigment for use in a cyan toner include C.I. Pigment Blue 2, 3, 15:2, 15:3, 15:4, 16, and 17; C.I. Vat Blue 6; C.I. Acid Blue 45; and a copper phthalocyanine pigment having a phthalocyanine skeleton substituted with 1 to 5 phthalimidomethyl groups.

An example of a dye for use in a cyan toner is C.I. Solvent Blue 70.

Examples of a pigment for use in a yellow toner include C.I. Pigment Yellow 1, 2, 3, 4, 5, 6, 7, 10, 11, 12, 13, 14, 15, 16, 17, 23, 62, 65, 73, 74, 83, 93, 94, 95, 97, 109, 110, 111, 120, 127, 128, 129, 147, 151, 154, 155, 168, 174, 175, 176, 180, 181, and 185; and C.I. Vat Yellow 1, 3, and 20.

An example of a dye for use in a yellow toner is C.I. Solvent Yellow 162.

In the present invention, the colorant content can be 1 part by mass or more and 20 parts by mass or less with respect to 100 parts by mass of the resin component.

The method for producing a toner according to the present invention will be specifically described below.

Step (1) Regarding Resin Microparticles

Resin microparticles having a sufficiently smaller particle size than a predetermined particle size of a toner are prepared. The resin microparticles preferably have a median size of 0.05 μm or more and 1.0 μm or less and more preferably 0.1 μm or more and 0.6 μm or less on a volume basis. A median size within the range described above is more likely to form toner particles having a predetermined particle size distribution and high pigment dispersion. The median size on a volume basis may be measured with a dynamic light scattering particle size distribution analyzer (Nanotrac UPA-EX150, manufactured by Nikkiso Co., Ltd).

In the present invention, the resin microparticles contain both of the olefinic copolymer and the resin A in view of the dispersion stability of an emulsion. In the step (1) in the present invention, the resin microparticles may be formed by a known method. A step of dissolving the olefinic copolymer and the resin A in an organic solvent can be included. A co-emulsion can be prepared by an emulsification method described below.

Specifically, the step (1) can include a substep of dissolving a copolymer (vinyl acetate copolymer) and the resin A in an organic solvent, the copolymer containing a unit represented by formula (1) where $R^1$ denotes H and a unit represented by formula (2) where $R^2$ denotes H, and $R^3$ denotes $CH_3$.

The olefinic copolymer and the resin A are dissolved in an organic solvent to prepare a uniform solution. A basic compound and a surfactant are added thereto. An aqueous medium is added to the solution to form resin microparticles. The solvent is removed to prepare a resin microparticle dispersion in which the resin microparticles are dispersed. In the case where the resin microparticles containing the olefinic copolymer and the resin A are formed by the foregoing emulsification method, the resin A and the olefinic copolymer are dissolved in microparticles of an organic phase. Thus, it is possible to form the resin microparticles in which the olefinic copolymer and the resin A are more uniformly mixed together. This seemingly enhances an effect in which the resin A inhibits the crystallization of the ethylene moieties of the olefinic copolymer, thereby further improving the particle size retention characteristics during the storage of the resin microparticles.

More specifically, the olefinic copolymer and the resin A are dissolved in the organic solvent by heating. The surfactant and the base are added thereto. The aqueous medium is slowly added thereto while shear is applied to the resulting mixture with a homogenizer, thereby preparing a resin-containing co-emulsion (resin microparticle dispersion). Alternatively, after the addition of the aqueous medium, shear is applied to the resulting mixture with the homogenizer, thereby preparing a resin-containing co-emulsion. The solvent is removed by heating or a reduction in pressure, thereby preparing a resin microparticle co-emulsion (resin microparticle dispersion).

The concentration of the resin component dissolved in the organic solvent is preferably 10 parts by mass or more and 50 parts by mass or less and more preferably 30 parts by mass or more and 50 parts by mass or less with respect to the organic solvent. Any organic solvent may be used for dissolution as long as it can dissolve the resin. A solvent, for example, toluene, xylene, or ethyl acetate, in which the olefinic copolymer has a high degree of solubility, can be used.

Examples of the surfactant used in the emulsification include, but are not limited to, anionic surfactants, such as sulfate ester salts, sulfonates, carboxylates, phosphates, and soaps; cationic surfactants, such as amine salts and quaternary ammonium salts; nonionic surfactants, such as polyethylene glycols, alkylphenol ethylene oxide adducts, and polyhydric alcohols. The anionic surfactant can be contained in an amount of 10 parts by mass or more and 30 parts by mass or less with respect to 100 parts by mass of the resin component in view of the dispersion stability in the step (1) and the step (2) described below. Two or more surfactants having different responses to aggregation and dispersion can be used in combination in view of the controllability of the particle size distribution in the step (2). In particular, the anionic surfactant can be a carboxylate-based surfactant or a sulfonate-based surfactant. Examples of the base used for emulsification include inorganic bases, such as sodium hydroxide and potassium hydroxide; and organic bases, such as triethylamine, trimethylamine, dimethylaminoethanol, and diethylaminoethanol. These bases may be used separately or in combination of two or more.

Step (2)

The step (2) is a step of mixing the resin microparticle dispersion with a colorant microparticle dispersion and a release agent microparticle dispersion to prepare a mixture, aggregating particles in the prepared mixture to form aggregated particles. Regarding a method for forming the aggregated particles, the acidic polar groups of the resin microparticles and the surfactant in the microparticle dispersion are used as reactive sites for the aggregation, and an ionic cross-linking effect is used. Specifically, a method can be exemplified in which an aggregating agent is used, the aggregating agent is added and mixed with the foregoing mixture, the temperature is increased, and mechanical power or the like is appropriately applied.

The olefinic copolymer does not have an acidic polar group. The formation of the resin microparticles containing the olefinic copolymer and the resin A in the step (1) seemingly allows the acidic polar groups of the resin A to serve as the reactive sites for the aggregation, thereby providing good controllability of the particle size distribution.

The colorant microparticle dispersion used in the step (2) is prepared by dispersing the colorant described above. The colorant microparticles are dispersed by a known method. Examples of the method that may be employed include rotary-shear homogenizers, media-type dispersers, such as ball mills, sand mills, and attritors, and high-pressure counter collision-type dispersers. A surfactant and a polymer dispersant that impart dispersion stability may be added, as needed.

The release agent microparticle dispersion used in the step (2) is prepared by dispersing the foregoing release agent in an aqueous medium. The release agent is dispersed by a known method. Examples of the method that may be employed include rotary-shear homogenizers, media-type dispersers, such as ball mills, sand mills, and attritors, and high-pressure counter collision-type dispersers. A surfactant and a polymer dispersant that impart dispersion stability may be added, as needed.

Examples of the aggregating agent used in the step (2) include metal salts of monovalent metals, such as sodium and potassium; metal salts of divalent metals, such as calcium and magnesium; metal salts of trivalent metals, such as iron and aluminum; and polyvalent metal salts, such as polyaluminum chloride. Divalent metal salts, such as calcium chloride and magnesium sulfate, and polyvalent metal salts, such as polyaluminum chloride, can be used in combination in view of particle size controllability in the step (2).

In the step (2), the aggregated particles can be formed in the presence of a silicone oil in view of pigment dispersion. That is, silicone oil microparticles are used as described in examples described below.

The addition and mixing of the aggregating agent can be performed in the temperature range of room temperature or higher and 75° C. or lower. When the mixing is performed within the temperature range, aggregation proceeds stably. The mixing may be performed with a known mixing apparatus, a homogenizer, or a mixer.

The average particle size of the aggregated particles formed in the step (2) is not particularly limited and may be usually controlled to 4.0 μm or more and 7.0 μm or less so as to be comparable to the average particle size of toner particles to be produced. The average particle size may be easily controlled by, for example, appropriately changing the temperature during the addition and mixing of the aggregating agent and the conditions of the mixing. The particle size of the toner particles may be measured with a particle size distribution analyzer (Coulter MultiSizer III, manufactured by Beckman Coulter, Inc.) using the Coulter method.

Step (3)

The step (3) is a step of heating the aggregated particles to a temperature equal to or higher than the melting point of the resin component and allowing the aggregated particles to coalesce to form toner particles having a predetermined form. To prevent the fusion of the toner particles, a chelating agent, a pH adjusting agent, or a surfactant may be appropriately added before the step (3).

The chelating agent, the pH adjusting agent, or the surfactant reacts with part of the aggregating agent ionically cross-linked with the acidic polar groups of the resin microparticles to terminate the progress of the aggregation, thus stabilizing the dispersion state of the aggregated particles. Examples of the chelating agent include ethylenediaminetetraacetic acid (EDTA) and its alkali metal salts, such as sodium salt thereof, sodium gluconate, sodium tartrate, potassium citrate, sodium citrate, nitrilotriacetate (NTA), and various water-soluble polymers (polyelectrolytes) each having both COOH and OH functional groups.

The heating temperature may be a temperature equal to or higher than the melting point of the resin component in the aggregated particles and a temperature lower than the thermal decomposition temperature of the resin component. Regarding the time required for the coalescence by heating, a higher heating temperature results in a shorter time, and a lower heating temperature results in a longer time. That is, the time required for the coalescence by heating depends on the heating temperature and is not completely specified. In general, the time is 10 minutes or more and 10 hours or less. In the emulsion aggregation method, the form of the toner may be easily controlled by controlling the temperature and time of the heating in the step (3). The toner can have an average circularity of 0.95 or more and 0.97 or less. An average circularity of 0.97 or more results in the degradation of the cleaning properties of the toner. An average circularity of 0.95 or less results in insufficient coalescence of the microparticles. After a predetermined average circularity of the aggregated particles is obtained, a cooling step is performed as described below. The average circularity of the toner particles is measured and calculated with a flow-type particle image analyzer "FPIA-3000" (manufactured by Sysmex Corporation) according to the operating manual of the analyzer.

The toner particles formed in the step (3) preferably have a median size of 4.0 μm or more and 7.0 μm or less and more preferably 5.0 μm or more and 6.0 μm or less on a volume basis from the viewpoint of producing a high-definition image.

The particle size distribution of the toner particles is measured with a particle size distribution analyzer (Coulter MultiSizer III, manufactured by Beckman Coulter, Inc.) using the Coulter method, thereby calculating a volume-average particle size D4 and a number-average particle diameter D1. In the toner particles produced by the method for producing a toner according to the present invention, the value of D4/D1 is preferably 1.0 or more and 1.5 or less and more preferably 1.0 or more and 1.2 or less.

Cooling Step

The cooling step is a step of lowering the temperature of the aqueous medium containing the particles to a temperature lower than the crystallization temperature of the olefinic copolymer. When the aqueous medium is not cooled to the temperature lower than the crystallization temperature, coarse particles are formed. A specific cooling rate is 0.1° C./min or more and 50° C./min or less.

Annealing can be performed in which the crystallization is promoted by holding the temperature at a temperature at which the crystallization speed of the olefinic copolymer is high during or after the cooling. The temperature is held at 30° C. or higher and 70° C. or lower to promote the crystallization, thereby improving the blocking resistance during the storage of the toner.

Smoothing Step

In the case of the toner particles produced in the step (3) under conditions in which a large amount of the surfactant is contained, microasperities having a width or height of 50 nm or more and 300 nm or less can be formed on surfaces of the toner particles, and fine particles having a particle size of 1 μm or less can be formed. If necessary, a smoothing step may be performed in which these microasperities and the fine particles are allowed to coalesce with the toner particles to smooth out the toner surfaces. The smoothing step may be performed in an aqueous medium after the step (3) or subsequent to the cooling step. Alternatively, the smoothing step may be performed after a drying step described below. In the case where smoothing is performed in the aqueous medium, the surfactant concentration is reduced, and then the temperature is raised by heating to a temperature equal to or higher than the melting point of the resin component. Regarding a method for reducing the surfactant concentration in the aqueous medium, filtration may be performed, followed by redispersion. Alternatively, water may be added to the aqueous medium. In the case where smoothing is performed after the drying step, a shear force is applied to deform the microasperities and the microparticles. In this case, inorganic particles or resin microparticles are added to improve flowability, as needed, so that the shear force can be uniformly applied to the toner particles.

Washing Step

Washing and filtration of the toner particles formed through the foregoing steps may be repeated to remove impurities in the toner particles. Specifically, the toner particles can be washed with an aqueous solution containing a chelating agent, for example, ethylenediaminetetraacetic acid (EDTA) or its sodium salt and then deionized water. By repeating the washing with deionized water and the filtration, the metal salt and the surfactant in the toner particles can be removed. The number of repetitions of the filtration is preferably 3 or more and 20 or less and more preferably 3 or more and 10 or less in view of production efficiency.

Drying Step

The toner particles formed through the foregoing steps are dried. If necessary, inorganic particles composed of, for example, silica, alumina, titania, or calcium carbonate or resin particles composed of, for example, a vinyl resin, a polyester resin, or a silicone resin may be added to the toner particles in a dry state with a shear force applied. These inorganic particles and the resin microparticles function as external additives, such as a flowability assistant and a cleaning assistant. In the case where the microasperities are formed on the surfaces of the toner particles or where the fine particles are formed, the effects of these external additives can be impaired. The smoothing step is performed as needed, thus sufficiently providing the effects of the external additives.

EXAMPLES

While the present invention will be described in more detail below by examples and comparative examples, embodiments of the present invention are not limited to these examples. In the examples and the comparative examples, "part(s)" and "%" are on a mass basis unless otherwise specified.

Preparation of Dispersion of Resin Microparticles 1

- Toluene (manufactured by Wako Pure Chemical Industries, Ltd.): 300 g
- Ethylene-vinyl acetate copolymer E1 (proportion of a unit derived from vinyl acetate: 15% by mass, melt flow rate: 12 g/10 minutes, melting point: 86° C., elongation at break: 700%): 100 g
- Resin A1 (composition (molar ratio): 1,9-nonanediol: sebacic acid=100:100, number-average molecular weight (Mn): 5500, weight-average molecular weight (Mw): 15,500, peak molecular weight (Mp): 11,400, melting point: 72° C., acid value: 13 mgKOH/g, SP value: 20.0 $(J/cm^3)^{0.5}$): 25 g Materials listed above were mixed together. The mixture was heated to 90° C. for dissolution.

Separately, 12 g of sodium dodecylbenzenesulfonate, 6.0 g of sodium laurate, and 1 g of N,N-dimethylaminoethanol were added to 700 g of deionized water and dissolved by heating to 90° C. The resulting aqueous solution and the foregoing toluene solution were mixed together. The mixture was stirred with an ultrahigh-speed stirring apparatus (T.K. Robomix, manufactured by Primix Corp.) at 7000 rpm. The mixture was emulsified with a high-pressure impact disperser (Nanomizer, manufactured by Yoshida Kikai Co., Ltd.) at a pressure of 200 MPa. Toluene was then removed with an evaporator. The concentration was adjusted with deionized water to prepare a 20% aqueous dispersion of resin microparticles 1 (dispersion of resin microparticles 1).

The median size of resin microparticles 1 on a volume basis was measured with a dynamic light scattering particle size distribution analyzer (Nanotrac, manufactured by Nikkiso Co., Ltd.) and found to be 0.45 μm.

Preparation of Dispersion of Resin Microparticles 2

A dispersion of resin microparticles 2 was prepared in the same way as the method for preparing the resin microparticles 1, except that the amount of the resin A1 used was changed to 50 g. The resin microparticles 2 had a median size of 0.50 μm on a volume basis.

Preparation of Dispersion of Resin Microparticles 3

A dispersion of resin microparticles 3 was prepared in the same way as the method for preparing the resin microparticles 1, except that the amount of the resin A1 used was changed to 15 g. The resin microparticles 3 had a median size of 0.55 μm on a volume basis.

Preparation of Dispersion of Resin Microparticles 4

A dispersion of resin microparticles 4 was prepared in the same way as the method for preparing the resin microparticles 1, except that the resin A1 was changed to resin A2 (composition (molar ratio): 1,12-dodecandiol:1,12-dodecandicarboxylic acid=100:100, number-average molecular weight (Mn): 9000, weight-average molecular weight (Mw): 37,700, peak molecular weight (Mp): 30,500, melting point: 85° C., acid value: 11 mgKOH/g, SP value: 19.3 $(J/cm^3)^{0.5}$). The resin microparticles 4 had a median size of 0.51 μm on a volume basis.

Preparation of Dispersion of Resin Microparticles 5

A dispersion of resin microparticles 5 was prepared in the same way as the method for preparing the resin microparticles 1, except that the resin A1 was changed to resin A3 (composition (molar ratio): 1,6-hexanediol:1,2-propanediol:1,8-octanedicarboxylic acid=50:50:100, number-average molecular weight (Mn): 3020, weight-average molecular weight (Mw): 7170, peak molecular weight (Mp): 6640, melting point: 31° C., acid value: 15 mgKOH/g, SP value: 20.8 $(J/cm^3)^{0.5}$). The resin microparticles 5 had a median size of 0.45 μm on a volume basis.

Preparation of Dispersion of Resin Microparticles 6

A dispersion of resin microparticles 6 was prepared in the same way as the method for preparing the resin microparticles 1, except that the resin A1 was changed to resin A4 (composition (molar ratio): 1,12-dodecanediol:1,2-dodecanediol:1,8-octanedicarboxylic acid=50:50:100, number-average molecular weight (Mn): 3810, weight-average molecular weight (Mw): 9590, peak molecular weight (Mp): 8800, melting point: 42° C., acid value: 5 mgKOH/g, SP value: 19.5 $(J/cm^3)^{0.5}$). The resin microparticles 6 had a median size of 0.52 μm on a volume basis.

Preparation of Dispersion of Resin Microparticles 7

A dispersion of resin microparticles 7 was prepared in the same way as the method for preparing the resin microparticles 1, except that the resin A1 was changed to resin A5 (composition (molar ratio): 1,9-nonanediol:trimellitic acid:1,10-decanedicarboxylic acid=100:5:100, number-average molecular weight (Mn): 6520, weight-average molecular weight (Mw): 14,100, peak molecular weight (Mp): 10,400, melting point: 69° C., acid value: 30 mgKOH/g, SP value: 19.9 $(J/cm^3)^{0.5}$). The resin microparticles 7 had a median size of 0.45 μm on a volume basis.

Preparation of Dispersion of Resin Microparticles 8

A dispersion of resin microparticles 8 was prepared in the same way as the method for preparing the resin microparticles 1, except that the resin A1 was changed to resin A6 (composition (molar ratio): 1,9-nonanediol:trimellitic acid:1,10-decanedicarboxylic acid=100:10:100, number-average molecular weight (Mn): 5270, weight-average molecular weight (Mw): 13,900, peak molecular weight (Mp): 9530, melting point: 67° C., acid value: 45 mgKOH/g, SP value: 20.2 $(J/cm^3)^{0.5}$). The resin microparticles 8 had a median size of 0.41 μm on a volume basis.

Preparation of Dispersion of Resin Microparticles 9

A dispersion of resin microparticles 9 was prepared in the same way as the method for preparing the resin microparticles 1, except that the resin A1 was changed to resin A7 (composition (molar ratio): 1,6-hexanediol:adipic acid=100:100, number-average molecular weight (Mn): 6200, weight-average molecular weight (Mw): 22,700, peak molecular weight (Mp): 18,600, acid value: 1 mgKOH/g, SP value: 21.0 $(J/cm^3)^{0.5}$). The resin microparticles 9 had a median size of 0.65 μm on a volume basis.

Preparation of Dispersion of Resin Microparticles 10

A dispersion of resin microparticles 10 was prepared in the same way as the method for preparing the resin microparticles 1, except that the ethylene-vinyl acetate copolymer E1 was changed to ethylene-vinyl acetate copolymer E2 (proportion of a unit derived from vinyl acetate: 20% by mass, melt flow rate: 14 g/10 minutes, melting point: 75° C., elongation at break: 800%). The resin microparticles 10 had a median size of 0.45 μm on a volume basis.

Preparation of Dispersion of Resin Microparticles 11

A dispersion of resin microparticles 11 was prepared in the same way as the method for preparing the resin microparticles 1, except that the ethylene-vinyl acetate copolymer E1 was changed to ethylene-vinyl acetate copolymer E3 (proportion of a unit derived from vinyl acetate: 28% by mass, melt flow rate: 20 g/10 minutes, melting point: 69° C., elongation at break: 800%). The resin microparticles 11 had a median size of 0.50 μm on a volume basis.

Preparation of Dispersion of Resin Microparticles 12

A dispersion of resin microparticles 12 was prepared in the same way as the method for preparing the resin microparticles 1, except that 6.3 g of sodium dodecylbenzenesulfonate and 3.1 g of sodium laurate were used. The resin microparticles 12 had a median size of 0.50 μm on a volume basis.

Preparation of Dispersion of Resin Microparticles 13

A dispersion of resin microparticles 13 was prepared in the same way as the method for preparing the resin microparticles 1, except that 18.8 g of sodium dodecylbenzenesulfonate was used and sodium laurate was not used. The resin microparticles 13 had a median size of 0.52 μm on a volume basis.

Preparation of Dispersion of Resin Microparticles 14

A dispersion of resin microparticles 14 was prepared in the same way as the method for preparing the resin microparticles 1, except that the ethylene-vinyl acetate copolymer E1 was changed to ethylene-ethyl acrylate copolymer E4 (proportion of a unit derived from ethyl acrylate: 25% by mass, melt flow rate: 20 g/10 minutes, melting point: 91° C., elongation at break: 900%). The resin microparticles 14 had a median size of 0.44 μm on a volume basis.

Preparation of Dispersion of Resin Microparticles 15

A dispersion of resin microparticles 15 was prepared in the same way as the method for preparing the resin microparticles 1, except that the ethylene-vinyl acetate copolymer E1 was changed to ethylene-methyl acrylate copolymer E5 (proportion of a unit derived from methyl acrylate: 25% by mass, melt flow rate: 20 g/10 minutes, melting point: 91° C., elongation at break: 900%). The resin microparticles 15 had a median size of 0.42 μm on a volume basis.

Preparation of Dispersion of Resin Microparticles 16

A dispersion of resin microparticles 16 was prepared in the same way as the method for preparing the resin microparticles 1, except that the resin A1 is not used. The resin microparticles 16 had a median size of 0.55 μm on a volume basis.

Preparation of Dispersion of Resin Microparticles 17

A dispersion of resin microparticles 17 was prepared in the same way as the method for preparing the resin microparticles 1, except that the resin A1 was changed to a cycloolefin polymer (acid value: 0 mgKOH/g, SP value: 17.6 $(J/cm^3)^{0.5}$). The resin microparticles 17 had a median size of 5.70 μm on a volume basis.

Preparation of Dispersion of Resin Microparticles 18

A dispersion of resin microparticles 18 was prepared in the same way as the method for preparing the resin microparticles 1, except that the resin A1 was changed to a polyester resin (composition (molar ratio): Bisphenol A-E02 adduct:Bisphenol A-PO2 adduct:trimellitic acid:terephthalic acid:dodecylsuccinic acid=17:34:6:23:20, number-average molecular weight (Mn): 4800, weight-average molecular weight (Mw): 150,000, peak molecular weight (Mp): 9600, glass transition temperature (Tg): 56° C., acid value: 11 mgKOH/g, hydroxyl value: 11 mgKOH/g, SP value: 23.1 $(J/cm^3)^{0.5}$). The resin microparticles 18 had a median size of 0.47 μm on a volume basis.

Preparation of Dispersion of Resin Microparticles 19

A dispersion of resin microparticles 19 was prepared in the same way as the method for preparing the resin microparticles 1, except that the ethylene-vinyl acetate copolymer E1 used in the step (1) regarding the resin microparticles was changed to ethylene-vinyl acetate copolymer E6 (proportion of a unit derived from vinyl acetate: 20% by mass, melt flow rate: 200 g/10 minutes, melting point: 75° C., elongation at break: 210%) and that the resin A1 was not used. The resin microparticles 19 had a median size of 0.22 μm on a volume basis.

Preparation of Dispersion of Resin Microparticles 20

A dispersion of resin microparticles 20 was prepared in the same way as the method for preparing the resin microparticles 1, except that the ethylene-vinyl acetate copolymer E1 was not used and that the amount of the resin A1 was 125 g. The resin microparticles 20 had a median size of 0.25 μm on a volume basis.

Preparation of Dispersion of Colorant Microparticles

Colorant (cyan pigment: Pigment Blue 15:3, manufactured by Dainichiseika Color & Chemicals Mfg. Co., Ltd.): 10.0 parts by mass Anionic surfactant (Neogen RK, manufactured by Dai-ichi Kogyo Seiyaku Co., Ltd.): 1.5 parts by mass Deionized water: 88.5 parts by mass Materials listed above were mixed together. The mixture was subjected to dispersion with a high-pressure impact disperser (Nanomizer, manufactured by Yoshida Kikai Co., Ltd.) for about 1 hour to prepare a 10% aqueous dispersion of microparticles of the colorant (colorant microparticle dispersion) in which the colorant was dispersed in water. The median size of the colorant microparticles on a volume basis was measured with a dynamic light scattering particle size distribution analyzer (Nanotrac, manufactured by Nikkiso Co., Ltd.) and found to be 0.20 μm.

Preparation of Dispersion of Aliphatic Hydrocarbon Microparticles

Aliphatic hydrocarbon (HNP-51, melting point: 78° C., manufactured by Nippon Seiro Co., Ltd.): 20.0 parts by mass Anionic surfactant (Neogen RK, manufactured by Dai-ichi Kogyo Seiyaku Co., Ltd.): 1.0 part by mass Deionized water: 79.0 parts by mass Materials listed above were charged into a mixing vessel equipped with a stirrer and heated to 90° C. The mixture was allowed to circulate through Clearmix W-Motion (manufactured by M technique Co., Ltd.) to perform dispersion treatment for 60 minutes. The conditions of the dispersion treatment were described below.

Outside diameter of rotor: 3 cm

Clearance: 0.3 mm

Number of revolutions of rotor: 19,000 rpm

Number of revolutions of screen: 19,000 rpm

After the dispersion treatment, cooling was performed to 40° C. under cooling conditions including a number of revolutions of the rotor of 1000 rpm, a number of revolutions of the screen of 0 rpm, and a cooling rate of 10° C./min, thereby preparing a 20% aqueous dispersion of the aliphatic hydrocarbon microparticles (dispersion of the aliphatic hydrocarbon microparticles). The 50%-particle size (d50) on a volume distribution basis of the aliphatic hydrocarbon microparticles was measured with a dynamic light scattering particle size distribution analyzer (Nanotrac, manufactured by Nikkiso Co., Ltd.) and found to be 0.15 μm.

Preparation of Silicone Oil Emulsion

Silicone oil (dimethyl silicone oil: KF96-50CS, manufactured by Shin-Etsu Chemical Co., Ltd.): 20.0 parts by mass Anionic surfactant (Neogen RK, manufactured by Dai-ichi Kogyo Seiyaku Co., Ltd.): 1.0 part by mass Deionized water: 79.0 parts by mass Materials listed above were mixed together. The mixture was subjected to dispersion with a high-pressure impact disperser (Nanomizer, manufactured by Yoshida Kikai Co., Ltd.) for about 1 hour to prepare a 20% aqueous dispersion of the silicone oil in which the silicone oil was dispersed in water. The median size of silicone oil particles in the resulting silicone oil emulsion on a volume basis was measured with a dynamic light scattering particle size distribution analyzer (Nanotrac, manufactured by Nikkiso Co., Ltd.) and found to be 0.09 μm.

Example 1

Dispersion of resin microparticles 1: 50 g

Dispersion of colorant microparticles: 5 g

Dispersion of aliphatic hydrocarbon microparticles: 5 g

Deionized water: 10 g

Silicone oil emulsion: 5 g

Materials listed above were charged into a round-bottom flask composed of stainless steel and mixed together. Then 3 g of a 2% aqueous solution of polyaluminum chloride and 30 g of a 2% aqueous solution of magnesium sulfate were added thereto. Dispersion was performed with a homogenizer (Ultra-Turrax T50, manufactured by IKA) at 5000 rpm for 10 minutes. The mixture was heated to 60° C. in a water bath under stirring with a stirring blade while the number of revolutions was appropriately adjusted in such a manner that the mixture was stirred. The mixture was held at 60° C. for 20 minutes. The volume-average particle size of the resulting aggregated particles was measured with Coulter MultiSizer III. The measurement revealed that the aggregated particles having a volume-average particle size of about 6.0 μm were formed.

To the dispersion of the aggregated particle, 120 g of a 5% aqueous solution of disodium ethylenediaminetetraacetate was added. Then 2000 g of deionized water was added thereto. The mixture was heated to 95° C. under stirring. The mixture was held at 95° C. for 1 hour to allow the aggregated particles to coalesce.

The mixture was cooled to 50° C. and held at the temperature for 3 hours to promote the crystallization of the ethylene-vinyl acetate copolymer. The mixture was cooled to 25° C., filtered, and subjected to solid-liquid separation. The filter residue was sufficiently washed with ethanol and then deionized water. After the completion of the washing, the filter residue was dried with a vacuum drying oven to give toner particles having a median size of 5.4 μm on a volume basis, a particle size distribution of 1.13, and a circularity of 0.965.

Subsequently, 100 parts by mass of the resulting toner particles was dry-mixed with 1.5 parts by mass of a fine silica powder that had been subjected to hydrophobic treatment and having a primary particle size of 10 nm and 2.5 parts by mass of a fine silica powder that had been subjected to hydrophobic treatment and having a primary particle size of 100 nm using a Henschel mixer (manufactured by Mitsui Mining Co., Ltd.) to produce a toner.

Example 2

A toner was produced as in Example 1, except that resin microparticles 2 were used in place of the resin microparticles 1. The toner particles had a median size of 5.1 μm on a volume basis, a particle size distribution of 1.11, and a circularity of 0.963.

Example 3

A toner was produced as in Example 1, except that resin microparticles 3 were used in place of the resin microparticles 1. The toner particles had a median size of 5.2 μm on a volume basis, a particle size distribution of 1.16, and a circularity of 0.962.

Example 4

A toner was produced as in Example 1, except that resin microparticles 4 were used in place of the resin microparticles 1. The toner particles had a median size of 5.2 μm on a volume basis, a particle size distribution of 1.10, and a circularity of 0.965.

Example 5

A toner was produced as in Example 1, except that resin microparticles 5 were used in place of the resin microparticles 1. The toner particles had a median size of 5.4 μm on a volume basis, a particle size distribution of 1.35, and a circularity of 0.961.

Example 6

A toner was produced as in Example 1, except that resin microparticles 6 were used in place of the resin microparticles 1. The toner particles had a median size of 5.4 μm on a volume basis, a particle size distribution of 1.41, and a circularity of 0.962.

Example 7

A toner was produced as in Example 1, except that resin microparticles 7 were used in place of the resin microparticles 1. The toner particles had a median size of 5.1 μm on a volume basis, a particle size distribution of 1.15, and a circularity of 0.963.

Example 8

A toner was produced as in Example 1, except that resin microparticles 8 were used in place of the resin microparticles 1. The toner particles had a median size of 5.2 μm on a volume basis, a particle size distribution of 1.15, and a circularity of 0.965.

Example 9

A toner was produced as in Example 1, except that resin microparticles 9 were used in place of the resin microparticles 1. The toner particles had a median size of 5.3 μm on a volume basis, a particle size distribution of 1.55, and a circularity of 0.960.

Example 10

A toner was produced as in Example 1, except that resin microparticles 10 were used in place of the resin microparticles 1. The toner particles had a median size of 5.2 μm on a volume basis, a particle size distribution of 1.17, and a circularity of 0.963.

Example 11

A toner was produced as in Example 1, except that resin microparticles 11 were used in place of the resin microparticles 1. The toner particles had a median size of 5.2 μm on a volume basis, a particle size distribution of 1.18, and a circularity of 0.964.

Example 12

A toner was produced as in Example 1, except that resin microparticles 12 were used in place of the resin microparticles 1. The toner particles had a median size of 5.6 μm on a volume basis, a particle size distribution of 1.45, and a circularity of 0.961.

Example 13

A toner was produced as in Example 1, except that resin microparticles 13 were used in place of the resin microparticles 1. The toner particles had a median size of 5.5 μm on a volume basis, a particle size distribution of 1.40, and a circularity of 0.961.

Example 14

A toner was produced as in Example 1, except that resin microparticles 14 were used in place of the resin microparticles 1. The toner particles had a median size of 5.6 μm on a volume basis, a particle size distribution of 1.41, and a circularity of 0.961.

Example 15

A toner was produced as in Example 1, except that resin microparticles 15 were used in place of the resin microparticles 1. The toner particles had a median size of 5.2 μm on a volume basis, a particle size distribution of 1.35, and a circularity of 0.961.

Comparative Example 1

A toner was produced as in Example 1, except that resin microparticles 16 were used in place of the resin microparticles 1. The toner particles had a median size of 10.3 μm on a volume basis, a particle size distribution of 1.65, and a circularity of 0.945.

Comparative Example 2

A toner was produced as in Example 1, except that resin microparticles 17 were used in place of the resin microparticles 1. The toner particles had a median size of 11.2 μm on a volume basis, a particle size distribution of 1.70, and a circularity of 0.942.

Comparative Example 3

A toner was produced as in Example 1, except that resin microparticles 18 were used in place of the resin microparticles 1. The toner particles had a median size of 15.4 μm on a volume basis, a particle size distribution of 1.65, and a circularity of 0.938.

Comparative Example 4

A toner was produced as in Example 1, except that resin microparticles 19 were used in place of the resin microparticles 1. The toner particles had a median size of 7.1 μm on a volume basis, a particle size distribution of 1.60, and a circularity of 0.962.

Comparative Example 5

A toner was produced as in Example 1, except that resin microparticles 20 were used in place of the resin microparticles 1, the silicone oil emulsion was not used, the amount of the dispersion of the aliphatic hydrocarbon microparticles added was 5 g, and the aggregation temperature was 60° C. The toner particles had a median size of 5.4 μm on a volume basis, a particle size distribution of 1.12, and a circularity of 0.98.

The foregoing toners were subjected to evaluation tests described below. Table 2 lists the evaluation results.

Evaluation of Particle Size Distribution

The toner particles were evaluated from the measurement results of the particle size distributions. Evaluation criteria are described below.

A: A median size of 4 μm or more and 7 μm or less on a volume basis, and a particle size distribution of 1 or more and 1.2 or less.

B: A median size of 4 μm or more and 7 μm or less on a volume basis, and a particle size distribution of more than 1.2 and 1.5 or less.

C: A median size of 4 μm or more and 7 μm or less on a volume basis, and a particle size distribution of more than 1.5.

D: A median size of less than 4 μm, or more than 7 μm on a volume basis.

Evaluation of Storage Stability (Blocking Resistance)

The toners were allowed to stand for two weeks in a temperature and humidity controlled bath set at a temperature of 40° C. and a humidity of 95%. The degree of blocking was visually evaluated according to evaluation criteria described below.

A: No blocking occurs, or even when blocking occurs, blocked particles are easily dispersed by minute vibrations.

B: Although blocking occurs, blocked particles are dispersed by continuous vibrations.

C: Blocking occurs, and blocked particles are not dispersed even if a force is applied.

Evaluation of Low-Temperature Fixability

Each of the toners was mixed with ferrite carrier (aggregated particles: 42 μm) surface-coated with a silicone resin in such a manner that the toner concentration was 8% by mass, thereby preparing a two-component developer. An unfixed toner image (0.6 mg/cm$^2$) was formed on image-receiving paper (64 g/m$^2$) with a commercially available full-color digital copier (CLC1100, manufactured by CANON KABUSHIKI KAISHA). A fixing unit removed from a commercially available full-color digital copier (imageRUNNER ADVANCE C5051, manufactured by CANON KABUSHIKI KAISHA) was modified in such a manner that the fixing temperature was able to be adjusted. The unfixed image was subjected to a fixing test with the modified fixing unit. The unfixed image was fixed at a process speed of 246 mm/s in a normal temperature and normal humidity environment. The resulting image was visually evaluated according to evaluation criteria described below.

A: Fixing can be performed at a temperature of 120° C. or lower.

B: Fixing can be performed at a temperature of higher than 120° C. and 140° C. or lower.

C: Fixing can be performed at a temperature of higher than 140° C., or no temperature region is present for fixing.

Evaluation of Charge Retention Rate

First, 0.01 g of each of the toners was weighed in an aluminum pan and charged to −600 V with a scorotron charger. Subsequently, the behavior of a change in surface potential was measured for 30 minutes in an atmosphere with a temperature of 25° C. and a humidity of 50% with a surface electrometer (model 347, manufactured by Trek Japan Co., Ltd). The charge retention rate was calculated from the measurement results using the following expression:

Charge retention rate after 30 minutes (%)=(surface potential after 30 minutes/initial surface potential)×100

Evaluation criteria are described below.

A: A charge retention rate of 90% or more.

B: A charge retention rate of 50% or more and less than 90%.

C: A charge retention rate of 10% or more and less than 50%.

D: A charge retention rate of less than 10%.

Evaluation of Image Density

The image density of each of the images fixed in "Evaluation of low-temperature fixability" was measured with an image densitometer (spectrodensitometer, manufactured by X-rite) and evaluated according to evaluation criteria described below.

A: An image density of 0.6 or more.

B: An image density of less than 0.6.

TABLE 1

| Example No. | Microparticle No. | Olefinic copolymer Type | Proportion of unit Y2 (% by mass) | Melt flow rate (g/10 minutes) | SP value $(J/cm^3)^{0.5}$ | Resin A Type | Acid value (mgKOH/g) | SP value $(J/cm^3)^{0.5}$ | Proportion of olefinic copolymer in resin component (% by mass) | Proportion of resin A in resin component (% by mass) | Amount of surfactant (parts by mass |
|---|---|---|---|---|---|---|---|---|---|---|---|
| Example 1 | 1 | E1 | 15 | 12 | 18.0 | A1 | 13 | 20.0 | 80 | 20 | 15 |
| Example 2 | 2 | E1 | 15 | 12 | 18.0 | A1 | 13 | 20.0 | 67 | 33 | 15 |
| Example 3 | 3 | E1 | 15 | 12 | 18.0 | A1 | 13 | 20.0 | 87 | 13 | 15 |
| Example 4 | 4 | E1 | 15 | 12 | 18.0 | A2 | 11 | 19.3 | 80 | 20 | 15 |
| Example 5 | 5 | E1 | 15 | 12 | 18.0 | A3 | 15 | 20.8 | 80 | 20 | 15 |
| Example 6 | 6 | E1 | 15 | 12 | 18.0 | A4 | 5 | 19.5 | 80 | 20 | 15 |
| Example 7 | 7 | E1 | 15 | 12 | 18.0 | A5 | 30 | 19.9 | 80 | 20 | 15 |
| Example 8 | 8 | E1 | 15 | 12 | 18.0 | A6 | 45 | 20.2 | 80 | 20 | 15 |
| Example 9 | 9 | E1 | 15 | 12 | 18.0 | A7 | 1 | 21.0 | 80 | 20 | 15 |
| Example 10 | 10 | E2 | 20 | 14 | 18.2 | A1 | 13 | 20.0 | 80 | 20 | 15 |
| Example 11 | 11 | E3 | 28 | 20 | 18.4 | A1 | 13 | 20.0 | 80 | 20 | 15 |
| Example 12 | 12 | E1 | 15 | 12 | 18.0 | A1 | 13 | 20.0 | 80 | 20 | 7.5 |
| Example 13 | 13 | E1 | 15 | 12 | 18.0 | A1 | 13 | 20.0 | 80 | 20 | 15 |
| Example 14 | 14 | E4 | 25 | 20 | 18.2 | A1 | 13 | 20.0 | 80 | 20 | 15 |
| Example 15 | 15 | E5 | 14 | 14 | 18.0 | A1 | 13 | 20.0 | 80 | 20 | 15 |
| Comparative example 1 | 16 | E1 | 15 | 12 | 18.0 | — | — | — | 100 | 0 | 15 |
| Comparative example 2 | 17 | E1 | 15 | 12 | 18.0 | COC | 0 | 17.6 | 80 | 0 | 15 |
| Comparative example 3 | 18 | E1 | 15 | 12 | 18.0 | PES | 11 | 21.9 | 80 | 20 | 15 |
| Comparative example 4 | 19 | E6 | 20 | 200 | 18.2 | — | — | — | 100 | 0 | 15 |
| Comparative example 5 | 20 | — | — | — | — | A1 | 13 | 20 | 0 | 100 | 15 |

TABLE 2

| Example No. | Evaluation result of toner: Particle size (μm) | Particle size distribution | Evaluation of particle size distribution | Low-temperature fixability | Charge retention rate | Image density | Storage stability |
|---|---|---|---|---|---|---|---|
| Example 1 | 5.4 | 1.13 | A | A | A | A | A |
| Example 2 | 5.1 | 1.11 | A | B | A | A | A |
| Example 3 | 5.2 | 1.16 | A | A | B | A | A |
| Example 4 | 5.2 | 1.10 | A | A | A | A | A |
| Example 5 | 5.4 | 1.35 | B | A | A | A | B |
| Example 6 | 5.4 | 1.41 | B | A | A | A | B |
| Example 7 | 5.1 | 1.15 | A | A | B | A | A |
| Example 8 | 5.2 | 1.15 | A | A | B | A | A |
| Example 9 | 5.3 | 1.55 | C | A | A | B | A |
| Example 10 | 5.2 | 1.17 | A | A | B | A | B |
| Example 11 | 5.2 | 1.18 | A | A | C | A | C |
| Example 12 | 5.6 | 1.45 | B | B | A | A | A |
| Example 13 | 5.5 | 1.40 | B | B | A | A | A |
| Example 14 | 5.6 | 1.41 | B | B | B | A | A |
| Example 15 | 5.2 | 1.35 | B | B | A | A | A |
| Comparative example 1 | 10.3 | 1.65 | D | C | A | B | A |
| Comparative example 2 | 11.2 | 1.70 | D | C | A | B | A |
| Comparative example 3 | 15.4 | 1.65 | D | C | A | B | A |
| Comparative example 4 | 7.1 | 1.60 | D | A | A | B | C |
| Comparative example 5 | 5.4 | 1.12 | A | A | D | A | B |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-107872, filed May 27, 2015, and Japanese Patent Application No. 2016-088542, filed Apr. 26, 2016, which are hereby incorporated by reference herein in their entirety.

The invention claimed is:

1. A method for producing a toner, comprising:

a step (1) of forming resin microparticles in an aqueous medium in the presence of a surfactant;

a step (2) of aggregating the resin microparticles to form aggregated particles; and a step (3) of heating the aggregated particles and allowing the aggregated particles to coalesce to form toner particles, wherein a resin component in the resin microparticles contains an olefinic copolymer and resin A, wherein the olefinic copolymer contains:

unit Y1 represented by formula (1), and unit Y2 that is at least one selected from the group consisting of a unit represented by formula (2) and a unit represented by formula (3), the olefinic copolymer has a melt flow rate equal to or more than 5 g/10 minutes and equal to or less than 30 g/10 minutes, the resin A has an acid value of 1 mgKOH/g or more and 50 mgKOH/g or less, the olefinic copolymer has a SP value of 16.0 $(J/cm^3)^{0.5}$ or more and 19.0 $(J/cm^3)^{0.5}$ or less, the resin A has a SP value of 19.0 $(J/cm^3)^{0.5}$ or more and 21.0 $(J/cm^3)^{0.5}$ or less, the resin component has an olefinic copolymer content of 50% by mass or more with respect to the total mass of the resin component, the resin component has a resin A content of 10% by mass or more and 50% by mass or less with respect to the total mass of the resin component, and the olefinic copolymer has a unit Y2 content of 3% by mass or more and 35% by mass or less with respect to the total mass of the olefinic copolymer, (1)

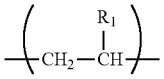

(2)

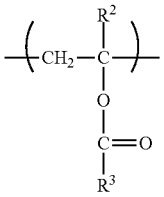

(3)

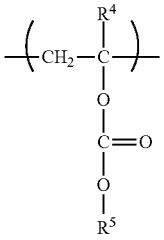

where $R^1$ denotes H or $CH_3$, $R^2$ denotes H or $CH_3$, $R^3$ denotes $CH_3$ or $C_2H_5$, $R^4$ denotes H or $CH_3$, and $R^5$ denotes $CH_3$ or $C_2H_5$.

2. The method for producing a toner according to claim 1, wherein the step (1) includes a substep of:

dissolving a copolymer and resin A in an organic solvent, the copolymer containing a unit represented by formula (1) where $R^1$ denotes H, and a unit represented by formula (2) where $R^2$ denotes H, and $R^3$ denotes $CH_3$.

3. The method for producing a toner according to claim 1, wherein resin A is an aliphatic polyester resin.

4. The method for producing a toner according to claim 1, wherein resin A has an acid value of 5 mgKOH/g or more and 50 mgKOH/g or less.

5. The method for producing a toner according to claim 1, wherein the olefinic copolymer has a unit Y2 content of 5% by mass or more and 20% by mass or less with respect to the total mass of the olefinic copolymer.

6. The method for producing a toner according to claim 1, wherein in the step (1), the surfactant is used in an amount of 10 parts by mass or more and 30 parts by mass or less with respect to 100 parts by mass of the resin component in the resin microparticles, and the surfactant is an anionic surfactant.

7. The method for producing a toner according to claim 1, wherein the surfactant is an anionic surfactant, and the anionic surfactant is a carboxylic-based surfactant or a sulfonic-based surfactant.

8. The method for producing a toner according to claim 1, wherein the step (2) is a step of aggregating the resin microparticles with an aggregating agent, wherein the aggregating agent is a polyvalent metal salt.

9. The method for producing a toner according to claim 1, wherein in the step (2), the aggregated particles are formed in the presence of a silicone oil.

10. The method for producing a toner according to claim 1, wherein the olefinic copolymer is at least one member selected from the group consisting of:

a copolymer containing a unit represented by formula (1) where $R^1$ denotes H, and a unit represented by formula (3) where $R^4$ denotes H, and $R^5$ denotes $CH_3$;

a copolymer containing a unit represented by formula (1) where $R^1$ denotes H, and a unit represented by formula (3) where $R^4$ denotes H, and $R^5$ denotes $C_2H_5$; and a copolymer containing a unit represented by formula (1) where $R^1$ denotes H, and a unit represented by formula (3) where $R^4$ denotes $CH_3$, and $R^5$ denotes $CH_3$.

* * * * *